US005763013A

United States Patent [19]

Devine et al.

[11] Patent Number: 5,763,013

[45] Date of Patent: Jun. 9, 1998

[54] EDGE REMOVAL APPARATUS INCLUDING AIR-FLOW BLOCKING MEANS FOR CURTAIN COATING

[75] Inventors: William D. Devine, Rochester; Douglas B. Humby, Hilton; Kenneth J. Ruschak, Rochester, all of N.Y.

[73] Assignee: Eastman Kodak Company, Rochester, N.Y.

[21] Appl. No.: 795,097

[22] Filed: Feb. 5, 1997

[51] Int. Cl.[6] ..... B05D 1/30; B05C 5/00

[52] U.S. Cl. ..... 427/420; 118/324; 118/DIG. 4

[58] Field of Search ..... 427/420, 294; 118/DIG. 4, 324, 50

[56] References Cited

U.S. PATENT DOCUMENTS 3,508,947 4/1970 Hughes .
4,647,482 3/1987 Degrauwe et al. ..... 118/DIG. 4
4,830,887 5/1989 Reiter .
5,328,726 7/1994 Reiter .
5,395,660 3/1995 Ruschak et al. ..... 427/420

FOREIGN PATENT DOCUMENTS

90/01179 2/1990 WIPO ..... 427/420

*Primary Examiner*—Katherine A. Bareford
*Attorney, Agent, or Firm*—Arthur H. Rosenstein

[57] ABSTRACT

The present invention is an edge blade attached to an edge guide for removing an edge of a falling curtain. The edge of the falling curtain is intercepted by the edge blade and is vacuumed away by a vacuum tube disposed near the edge blade wherein the air flow is blocked to said suction means from the outboard direction and directing said suction means to draw air from the inboard direction towards the curtain; and flushing liquid is distributed to encompass the intercepted liquids of the free falling curtain.

10 Claims, 5 Drawing Sheets

EDGE REMOVAL APPARATUS INCLUDING AIR-FLOW BLOCKING MEANS FOR CURTAIN COATING

FIELD OF THE INVENTION

This invention relates generally to coating apparatus and, more particularly, to the curtain coating of multiple layers.

BACKGROUND OF THE INVENTION

In coating apparatus of the curtain coating type, the moving support is coated by causing a free falling curtain of coating liquid to impinge onto the moving support to form a layer on said support. An apparatus is described and used in U.S. Pat. No. 3,508,947 wherein a multilayer composite of a plurality of distinct layers is formed on a slide hopper and caused to impinge onto an object or moving support to form a coated layer thereon. U.S. Pat. No. 3,508,947 particularly relates to the manufacture of multilayer photographic materials such as photographic film and paper.

In the coating of photographic products it is necessary to constrain the edges of the curtain to eliminate narrowing of the curtain and a reduction in coating width. It is desirable to have the edges of the curtain be internal to the edges of the film or paper base, henceforth this will be referred to as internal edging. Internal edging is preferable to the practice of maintaining a curtain wider than the base and coating over the edges of the base. However, the edge guides are solid surfaces which slow the coating liquids because of drag they produce. This reduction in velocity results in a significant penalty in the maximum coating speed attainable near the edge. The prior art teaches introducing a lubricating band of water, or another low viscosity liquid, along the edge guide to reduce the drag and increase the velocity of the coating solutions in the curtain. This water layer or low viscosity liquid band must, however, be removed in order to maintain acceptable coating latitude and quality and to avoid any penalty in speed for drying the edges. In the removal of the lubricating band the velocity of the coating liquids must not be reduced in the vicinity of the edge if high speed coating is desired. The prior art teaches the use of a vertical slit connected to a vacuum source at the bottom of the edge guide as the means by which the lubricating water is removed. This is described in U.S. Pat. No. 4,830,887 which is incorporated by reference herein. This technique tends to slow down the coating liquids as the lubricating layer is being removed, hence reducing the maximum attainable coating speed at the edge. Also, some lubricating liquid may flow beyond the slit and not be captured.

Therefore, it is desirable to remove the lubricating liquid band very abruptly giving the coating liquids near the edge guide very little opportunity to slow down. This maximizes the momentum of the coating liquids in the falling curtain and therefore, maximizes the attainable coating speeds for the specific layer viscosities and flow rates being used. It is also desirable to ensure complete removal of the lubricating liquid.

U.S. Pat. No. 5,395,660 describes a method and apparatus by which the lubricating layer of liquid and/or edge of the curtain in a curtain coating operation are removed. This is achieved by having the lubricating liquid and optionally, an adjacent narrow section of the curtain fall onto a thin solid blade. The lubricating liquid and curtain which impinge on the blade are then vacuumed away. This allows the remaining curtain to coat with little or no reduction in velocity due to the removal of the edge band of the falling curtain.

The instant invention is an improvement to the U.S. Pat. No. 5,395,660, Edge Removal Apparatus for Curtain Coating, issued Mar. 7, 1995. This device uses a blade and vacuum to remove the edges of curtains at the point of coating (FIG. 1). The blade intercepts the edge guide flushing liquid and some portion of the freely falling curtain. The vacuum removes these intercepted liquids. In the preferred embodiment, the vacuum means is a slot connected to a vacuum source. The blade and slot together are referred to as a vacuum block. It has been found that coating compositions with a tendency to solidify may cause fouling of the vacuum block according to U.S. Pat. No. 5,395,660.

When the coating composition includes a setting polymer such as bone gelatin, the solidification can be caused by below ambient temperatures on surfaces of the vacuum block. As the air drawn into the vacuum slot expands, it cools by at least several degrees and lowers the temperature of surrounding surfaces. Coating compositions contacting the block may then solidify.

When the coating composition is undergoing a cross-linking reaction, the solidification can be caused by this reaction proceeding on contacted surfaces of the vacuum block. In the manufacture of photographic products, the coating composition may include the gelatin polymer and a cross-linking agent, or hardener. The rate of this reaction increases with the concentrations of the reactants.

When the coating composition includes one or more volatile components subsequently evaporated in a dryer, the solidification can be due to evaporation from wetted surfaces. Water is a common volatile component. Common solvents, such as acetone or alcohols, are much more volatile than water.

Whatever the mechanism for fouling, it has been found that over time, buildup occurs on exterior and interior surfaces of the vacuum block of the prior art. This buildup reduces the efficiency of the unit at extracting the portion of the curtain intercepted by the blade and ultimately plugs the unit completely. Thus, excess coating composition and eventually the edge guide flushing liquid are deposited on the web. The edges of the coating may therefore not dry causing such problems as contamination of web conveyance components and wound rolls of coated web that are stuck together at the edges.

It is surprising that any buildup should occur, because the high velocity air drawn into the vacuum block scours surfaces. The time for solidification would be expected to be long compared to the brief time that the coating composition might contact the vacuum block. What is more, the edge guide flushing liquid drawn into the vacuum block with the intercepted coating composition would be expected to flush the surfaces of the vacuum block.

In fact, however, there is a tendency for fouling. The fouling can even take place along the line of three phase contact where the block surface meets both air and the edge guide flushing liquid. Presumably such a surprising buildup of coating composition is possible because the higher surface tension of the flushing liquid, as required for curtain stability at the edge guide, drags a skin of coating composition over the entire air surface of the flushing liquid. Depending upon the nature of the coating composition, partial plugging reducing the removal efficiency of the vacuum block and shutting down the coating operation can occur in as little time as an hour. In some cases, continuous coating for periods of days is desired.

SUMMARY OF THE INVENTION

The invention solves the problem of the fouling and clogging of the prior art vacuum block. The fouling represents solidified coating composition on the block.

Unexpectedly, it has been found that minimizing the extent of the intercepted coating compositions intercepted by the blade reduces the time to failure, even though the flushing liquid represents a greater proportion of the evacuated liquids. The intercepted coating composition becomes waste, so minimizing the amount of the curtain liquid intercepted is economically attractive.

A new way to reduce fouling and extend run times, has been found. The solution is to distribute flushing liquid so as to encompass the extracted coating compositions. This outcome is surprising, because flushing liquid is already present, and particularly because buildup occurs along the line of three phase contact where the block surface, the flushing liquid, and air meet. Either the edge guide flushing liquid already present can be redistributed, or additional flushing liquid can be supplied and distributed. The key is not the presence of flushing liquid, but its distribution.

In the prior art, FIG. 1, the vacuum slot is spaced uniformly from the curtain by approximately 1 mm. The improvement shown in FIG. 2 involves distributing the edge guide flushing liquid from flushing means 30 to encompass the intercepted portion of the coating liquids and requires that the flushing liquid make wetting contact with both the blade and the face of the slot. This is accomplished by contacting the face of the slot with the edge guide and by making the face vertical to extend the contact length as shown in FIGS. 2, 3, and 4. From the region of wetting contact, channels are cut in the slot face and blade surfaces to carry flushing liquid to encompass the intercepted coating liquids. At least one channel leads to the blade and mates with at least one channel in the blade that extends across all or a portion of the slot entrance (FIG. 3). In this way, flushing liquid is brought between the blade surface and back surface of the intercepted coating liquids. At least one other channel is cut in the slot face leading to the upper surface of the slot (FIG. 4). Flushing liquid is brought to some portion or all of the top surface of the slot and the side surface of the slot in proximity to the blade edge. In this way, flushing liquid is brought between the top and inboard side surfaces of the slot and the front surface of the intercepted coating liquids.

Instead of utilizing the edge guide flushing liquid, additional flushing liquid can be supplied as shown in FIG. 5. At least one water channel is cut in the blade to bring water from an external supply to the blade surface at the threshold of the slot. This channel conveys flushing liquid to a portion or all of the blade surface at the slot entrance. Preferably the channel extends at least to the line of apparent intersection of the curtain and blade. Similarly, an externally supplied channel can be constructed to bring flushing liquid from an external source to the top and inboard sides of the slot. A more direct alternative is to create a conduit in the vacuum block that terminates in the top surface of the slot as shown in FIG. 6. The outlet of the conduit spans some portion or all of the top surface of the slot. The outlet must also be close to the slot entrance, within about 0.050 inch, or fouling can occur between the slot entrance and the outlet. For this reason the shape of the outlet is preferably squared off as shown in FIG. 6. The principal advantage of the conduit is that complete capture of the flushing liquid is certain.

Gravity and capillary wicking cause flushing liquid to fill the channels. Preferably the channels have a downward inclination to make use of gravity. To enhance capillary wicking, the channels are preferably narrow and of rectangular cross section. Capillary wicking in such channels can be so strong that flushing liquid can be carried even vertically upward, although a downward inclination is preferable.

We do not know for certain why channeling the flushing liquid eliminates the tendency for fouling to occur along the line of three phase contact where the block surface meets both air and the edge guide flushing liquid. However, we speculate that flow toward the line of contact, as observed with a vacuum block according to the prior art, may cause the skin of coating composition to accumulate there. In contrast, distribution channels cause the flushing liquid to flow tangentially to the line of three phase contact so that the skin of coating composition is not impeded. When flushing liquid in addition to the edge guide flushing liquid is supplied directly to the vacuum block, any surface skin of coating composition that might develop would likely have diminished thickness compared to that on the edge guide flushing liquid.

Thus, a method of curtain coating a support with at least one layer of a liquid coating composition comprises:

a) moving the support along a path through the coating zone;

b) forming one or more layers of coating liquids to form a composite layer;

c) forming a free falling curtain from said composite layer within said coating zone which extends transversely of said path and impinges on said moving support;

d) laterally guiding said falling curtain by edge guides arranged so that the curtain coats less than the width of said support;

e) maintaining said falling curtain in wetting contact with said edge guides by distributing flushing liquid from said edge guides contiguous with said falling curtain;

f) removing liquids from the edge of said falling curtain by providing a blade extending from the edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at the edge guide;

g) removing by suction means the liquids of the free falling curtain intercepted by the blade; and h) additional flushing liquid is distributed to encompass the intercepted liquids of the free falling curtain.

Apparatus wherein:

a) the flush liquid distributing means is one or more channels, said channels selected from the group consisting of a channel beginning in wetting contact with the edge guide flushing liquid and cut transversely into the blade, and extending across all or a portion of the slot entrance at a distance not farther than the line of curtain/blade intersection and a channel beginning in wetting contact with the edge guide flushing liquid and cut transversely above the slot so as to intercept all or some portion of the top and inboard side surfaces of the slot or the flush distributing means can be both sets of channels;

b) the channels have a width of 0.020–0.1 inch and a depth of 0.010–0.100 inch preferably having a width of 0.020–0.060 inch and a depth of 0.010–0.040 inch;

c) the edge guide flushing liquid has a flow rate of 5–50 cubic centimeters per minute and preferably a flow rate of 30 cubic centimeters per minute.

More preferred is apparatus wherein a) the flush liquid distributing means is cut into the blade is one or more channels selected from the group consisting of a channel cut into the blade and externally supplied with flushing liquid, the channels extending from a supply means to at least a line of curtain/blade intersection, and bridging all or a portion of a slot entrance and a channel which is a conduit externally supplied with flushing liquid, the conduit extending from a supply means to an outlet in a top surface of the slot spanning a portion or all of the slot width, the outlet being set back no more than 0.050 inches from the slot entrance;

b) the blade channels have a width of 0.020–0.1 inch and a depth of 0.010–0.100 inch;

c) the channels are supplied with flushing liquid at the rate of 5–50 cubic centimeters per minute; and d) the conduit is supplied with flushing liquid at the rate of 10–100 cubic centimeters per minute.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

Figure 2:
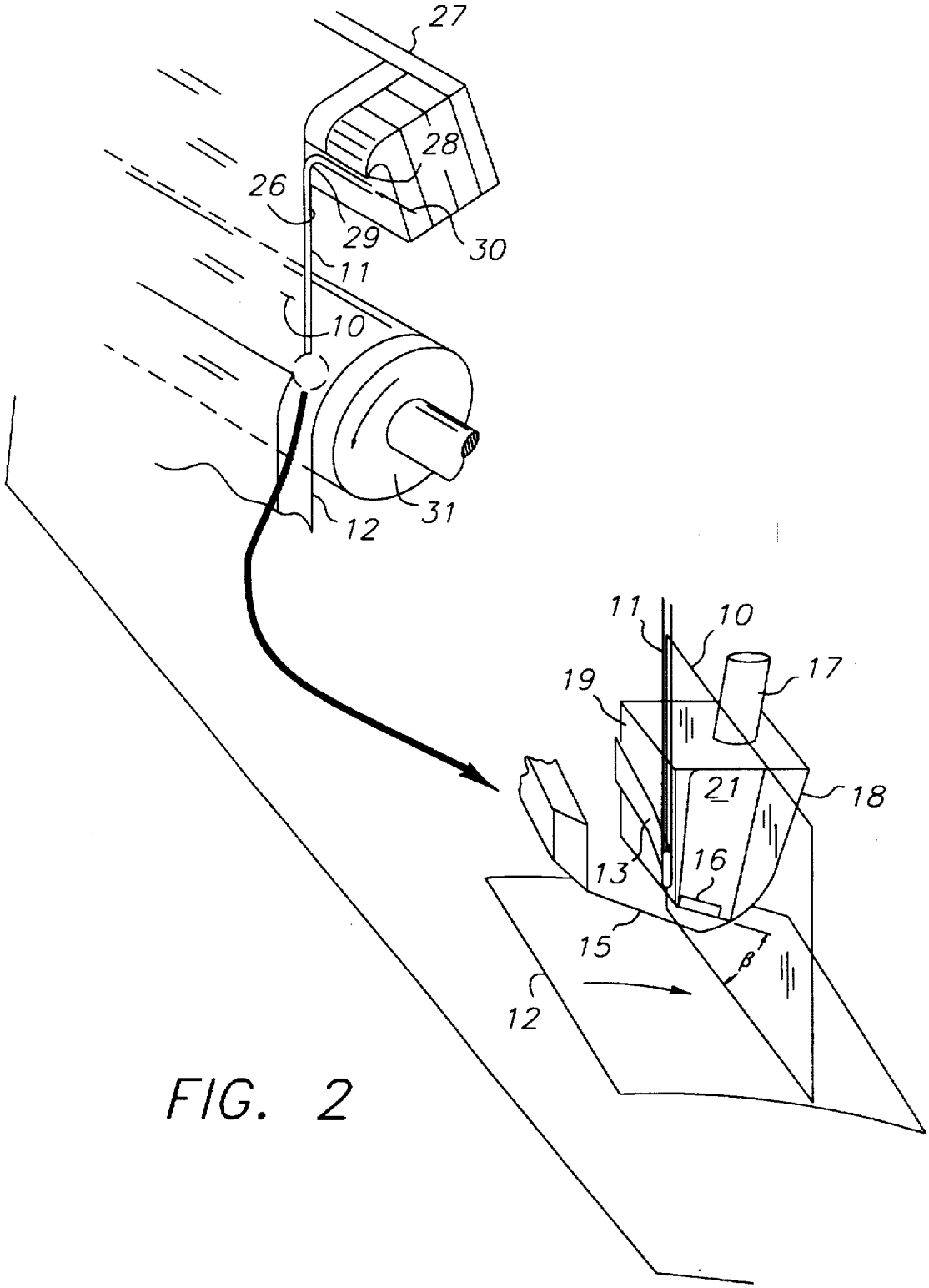
FIG. 2 shows the addition of flushing distribution means consisting of channels beginning in wetting contact with the edge guide flushing liquid and ending at or near the perimeter of the slot entrance.

The preferred embodiment is the flush water distributing means that is supplied either from the edge guide flushing liquid or from additional supplies. Examples of the preferred embodiment are shown by FIG. 2 and FIG. 5.

Figure 1:
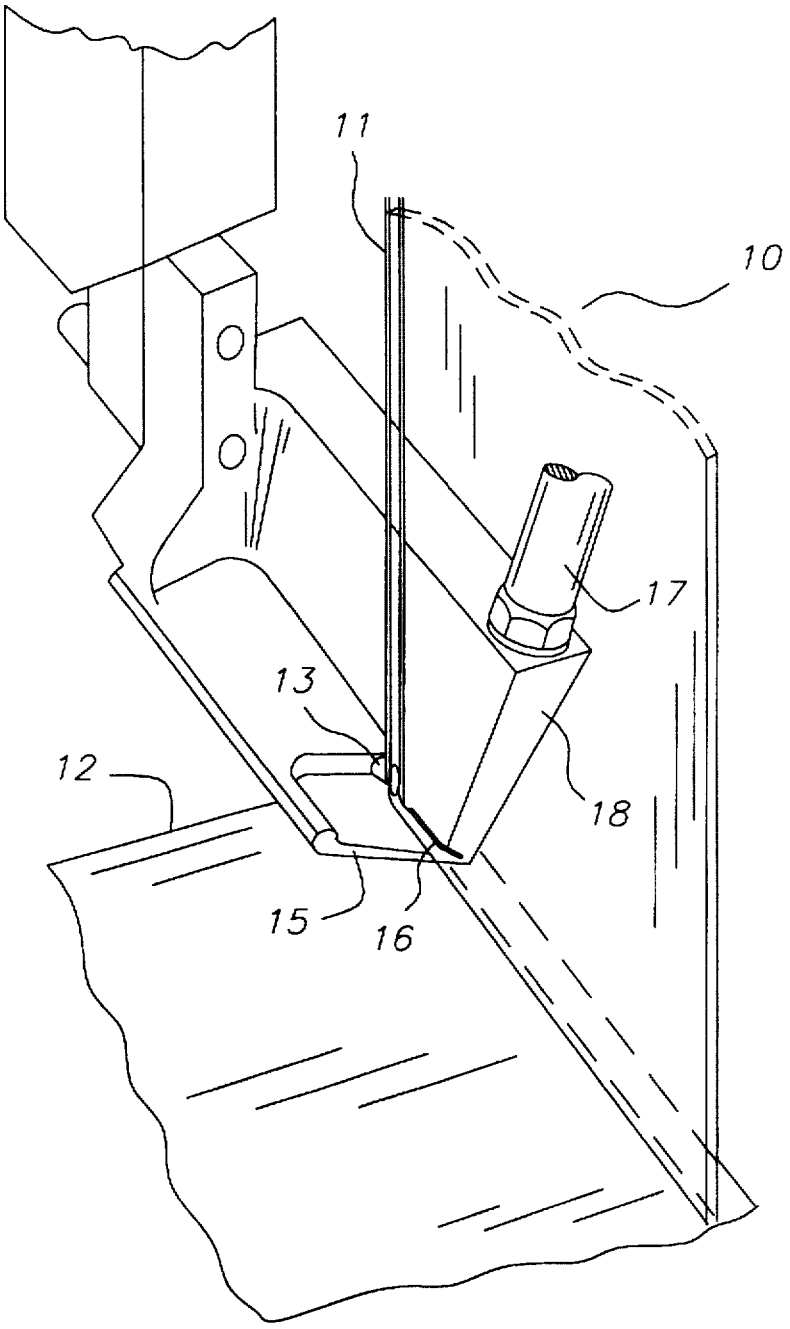
FIG. 1 shows the edge removal means of the prior art. The vacuum slot runs parallel to the curtain at a distance of about 1 mm. The face of the slot is inclined to the vertical and is not in contact with the edge guide. The slot extends to the edge of the blade.

FIG. 1 shows a curtain 10 and the lower portion of edge guide 11 according to the prior art of U.S. Pat. No. 5,395,660. The edge guide maintains the width of the curtain from the hopper lip 28, of hopper means 27 to the support 12 to be coated. The conveying means for the support shown in FIG. 2 is a roller 31. For the wire edge guide 11 shown in FIG. 2, a pin 13 maintains tension and position. A band of lubricating liquid 26 formed by distributing means 29 from supply 30 adjoins the edge guide and is preferably removed prior to coating the support. The lubricating liquid and an adjoining band of the coating composition are intercepted by a solid blade 15 spaced closely to the support and removed by a slot 16 adjacent the blade connected to a vacuum inlet 17. The entrance to the vacuum slot 16 runs parallel to the curtain at a distance of about 1 mm. The unit comprising the blade, slot, and vacuum inlet may be removable from the edge guide and is called the vacuum block 18.

Figure 3:
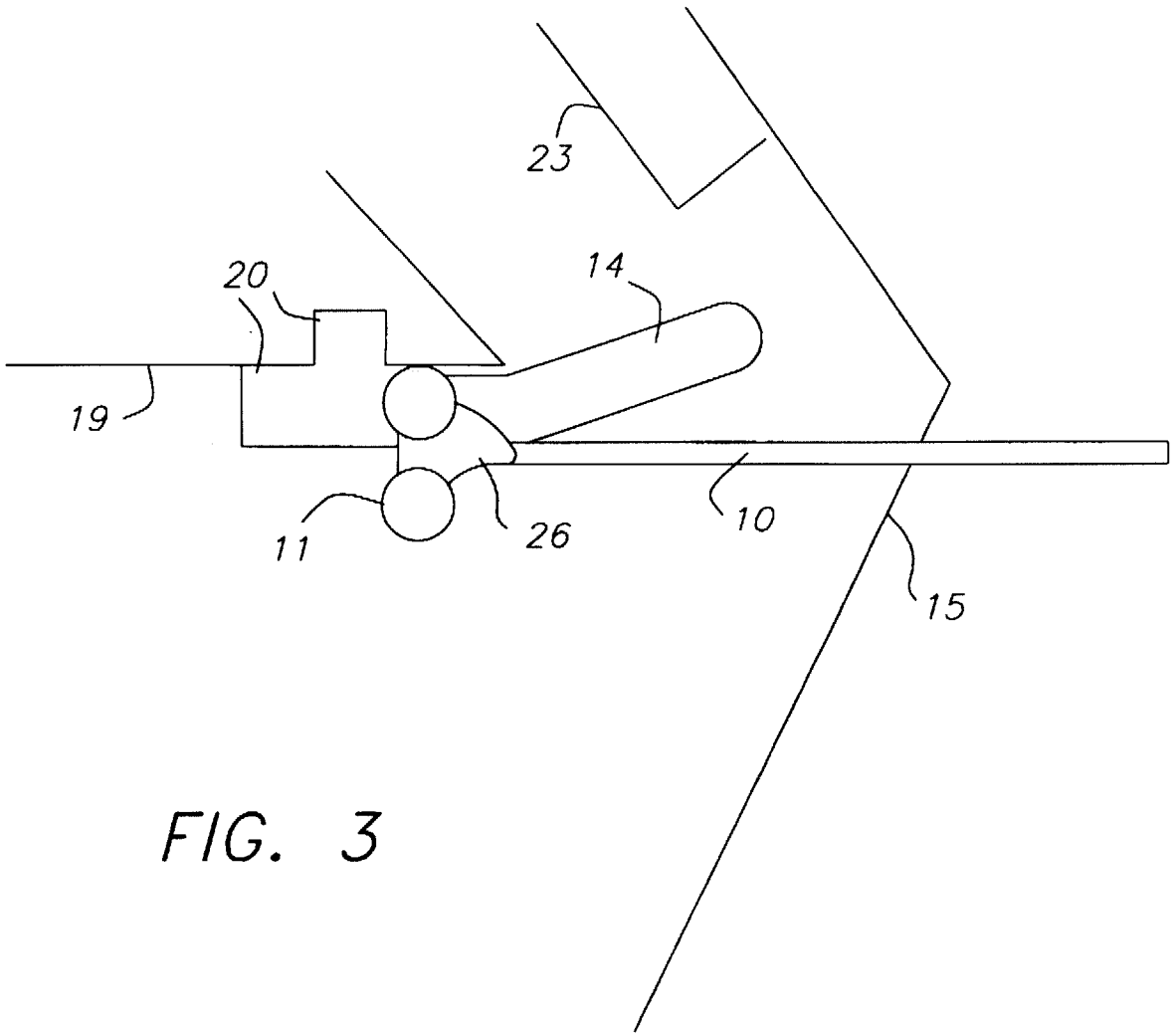
FIG. 3 is a view of the apparatus of FIG. 2 from above, cross sectioned at the plane of the blade surface. To show the proximity of the edge guide to the vertical face of the vacuum block that facilitates wetting contact, the positions of the edge guide wires and curtain are also indicated although these do not extend to the blade surface.
Figure 4:
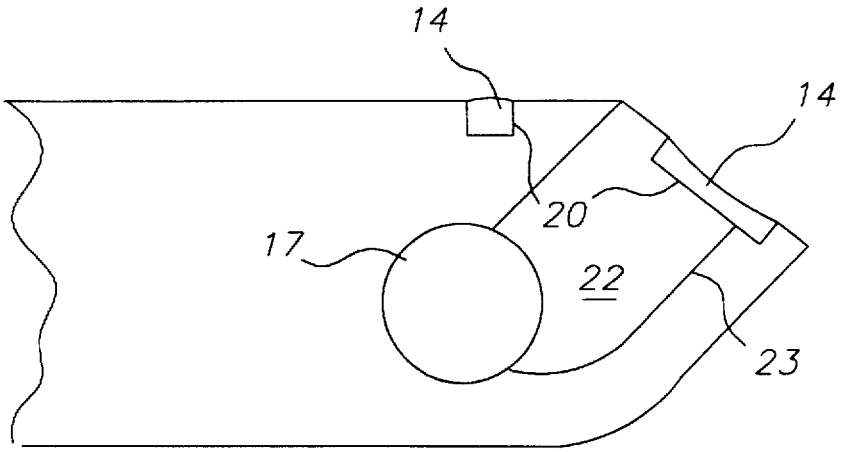
FIG. 4 is a view of the vacuum block in the plane of the blade viewed perpendicularly. The ends of the channels in the face of the block supplying the blade surface and the top and inboard surfaces of the slot with flushing liquid are shown.

Redistributing the edge guide flushing liquid 26 to encompass the intercepted portion of the coating liquids requires that the edge guide flushing liquid makes wetting contact with both the blade and the face of the slot. The slot is aligned and adjacent the upper surface of said blade, the face surface of the slot starting as a vertical surface in contact with the edge guide, and said slot making an angle $\beta$ with the plane of the curtain such that the distance of the slot from the curtain increases as the edge of the blade extending into the curtain is approached, and terminating the slot before the edge of the blade. Wetting is accomplished by contacting a vertical face 19 of the vacuum block 18 with the flushed edge guide 11 as shown in FIGS. 2 and 3. From the region of wetting contact on vertical face 19, channels 20 are cut in the slot face 21 and blade 15 surfaces to carry flushing liquid to encompass coating liquids intercepted by the blade. At least one channel leads to the blade and mates with at least one channel in the blade that extends across all or a portion of the slot entrance as shown in FIG. 3. In this way, flushing liquid is brought between the blade surface and the opposing surface of the intercepted coating liquids. At least one other channel is cut in the slot face 21 leading to the upper edge of the slot entrance as shown in FIGS. 2 and 4. In this way a portion of the edge guide flushing liquid is brought to some portion or all of the top internal surface 22 of the slot 16 and the side surface of the slot in proximity to the blade edge 23. In this way, flushing liquid is brought between these surfaces of the slot and the opposing surface of the intercepted coating liquids.

Figure 6:
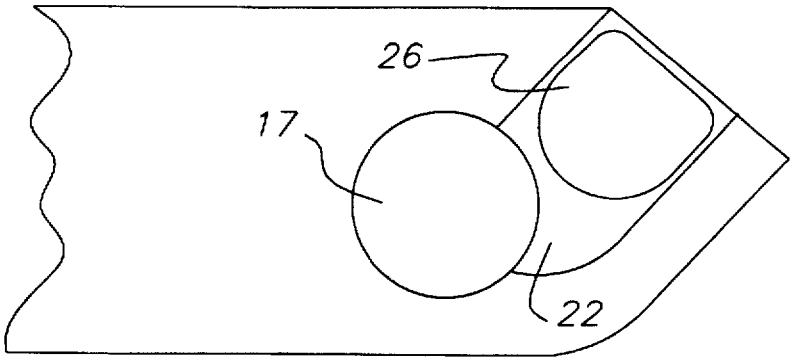
FIG. 6 is a view of the vacuum block with externally supplied flushing liquid from below in the plane of the top surface of the slot. The outlet for the internal conduit for the flushing liquid is shown.
Figure 5:
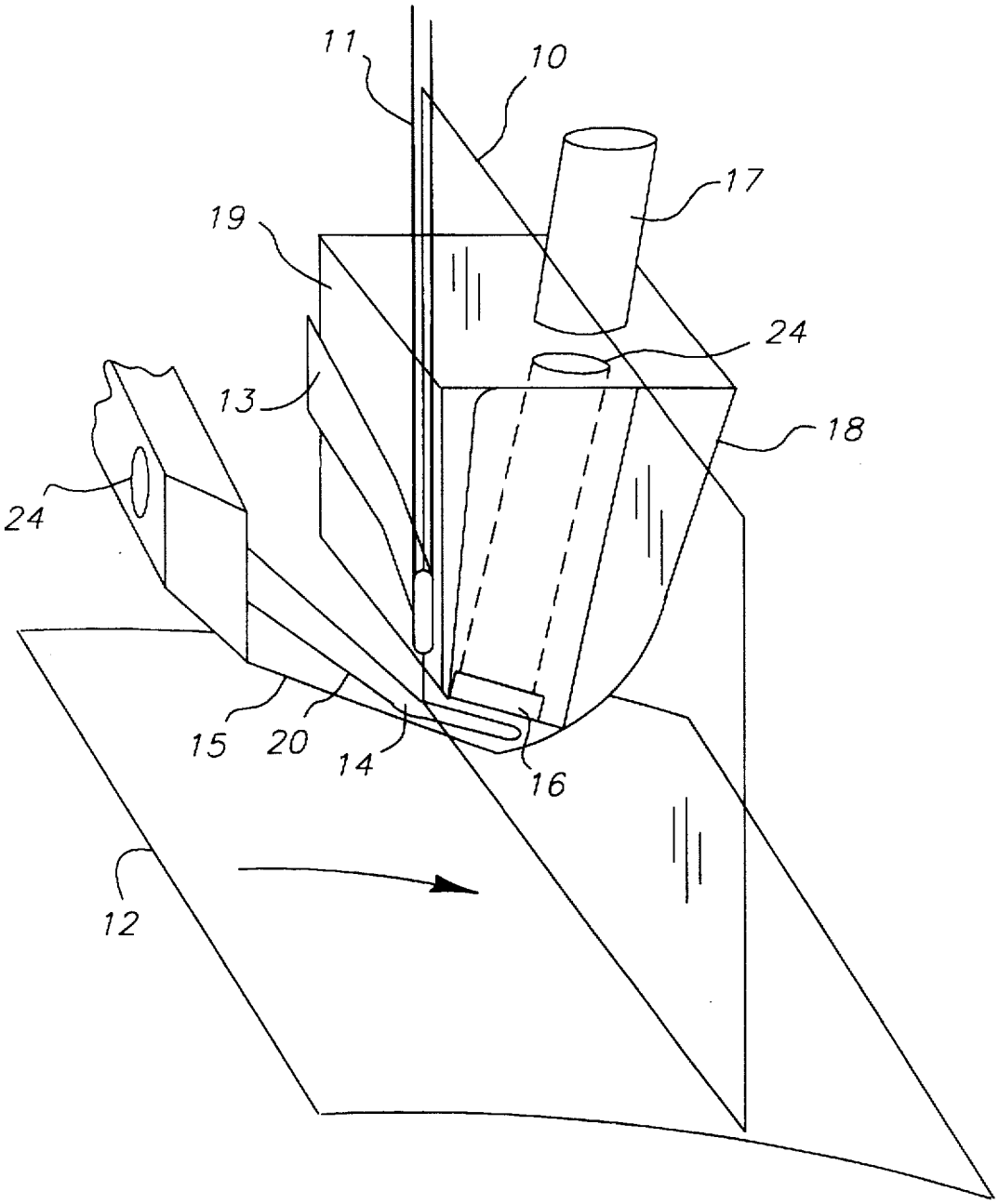
FIG. 5 (PRIOR ART)
FIG. 5 is a view of the vacuum block with flushing liquid in addition to the edge guide flushing liquid supplied externally. The inlets for the flushing liquid are shown. A channel in the blade delivers the flushing liquid to the threshold of the vacuum slot. A conduit through the block brings flushing liquid to the top surface of the slot.

Instead of redistributing the edge guide flushing liquid, additional flushing liquid can be supplied as shown in FIG. 5. Flushing liquid from supply 30 to an inlet 24 in the vacuum block 18 supplies to at least one channel 20 cut in the blade. The channels supply flushing liquid to the blade surface at the threshold of slot 16. Preferably the channel extends at least to the line of apparent intersection of the curtain 10 and blade 15. Similarly, at least one externally supplied channel can be constructed to bring flushing liquid to the top surface 22 and inboard surface 23 of slot 16. A more direct alternative is to create a conduit 25 in the vacuum block to convey flushing liquid from a supply 30 to an outlet 26 in the top surface 22 of slot 16. The outlet must also be close to the slot entrance, within about 0.050 inch, or fouling can occur between the slot entrance and the outlet. To this end the shape of the outlet can be squared off as shown in FIG. 6. The principal advantage of the conduit over channels on the outside surface of the channel block is that complete capture of the flushing liquid is certain.

Gravity and capillary wicking cause flushing liquid to fill the channels. Preferably the channels have a downward inclination to make use of gravity. To enhance capillary wicking, the channels are preferably narrow and of rectangular cross section. Capillary wicking in such channels can be so strong that flushing liquid can be carried even vertically upward, although a downward inclination is preferable.

EXAMPLE

An experiment was performed to compare the performance of the prior art (U.S. Pat. No. 5,393,660) edge liquid removal apparatus (vacuum block) to that of the current invention. A liquid curtain was formed by means of a slide hopper. The liquid curtain consisted of an aqueous solution of gelatin, surfactant, and hardening agent. The solution was 15 percent gelatin by weight. Viscometric measurements conducted at the temperature of the falling curtain showed that the reaction of the hardening agent with the gelatin was such that the gelatin would be crosslinked to such a degree so as to be considered solidified after a period of approximately 130 minutes. This represents a solidification rate that is substantially accelerated over normal operating conditions thereby allowing for evaluation of the propensity for deposition of solidified coating material on edge liquid removal devices in a relatively short amount of time. The viscosity of the liquid curtain was 74 centipoise, and the flow rate was 1.3 cc/s per cm of curtain width.

The curtain was anchored on each vertical edge by a pair of wires. Edge guides of this type are described in U.S. Pat. No. 5,328,726. The edge guide flushing liquid was water flowing at 30 cc/min.

On one vertical edge of the curtain, an edge liquid removal apparatus in accordance with the prior art was used. On the other vertical edge, an edge liquid removal apparatus in accordance with the current invention as shown in FIG. 2 and previously described was used. Flush liquid distributing means consisted of channels cut transversely into the blade and above the slot that were in wetting contact with the edge guide flushing water. The channel above the slot had a depth of 0.020 inch and a width of 0.032 inch. The channel in the blade had a depth of 0.015 inch and a width of 0.050 inch at the threshold of the slot entrance.

Both edge liquid removal devices intercepted a portion of the free falling curtain of approximately 0.125 inch, including the edge guide flushing water. Both edge liquid removal devices were connected to a common vacuum source by means of duplicate conduits and fittings. The vacuum levels for both devices were initially set to 130 inches of water below atmospheric pressure by means of separate air bleed valves.

At the beginning of the experiment, both edge liquid removal devices were rinsed with water. After two hours from the start of the experiment, it was observed that the efficiency of the prior art edge liquid removal apparatus in removing the falling curtain was reduced. Less of the coating composition intercepted by the blade was being removed. There was no degradation in the performance of the edge liquid removal device of the invention. Such a reduction in efficiency could result in a shutdown of a coating operation, depending upon drying capabilities.

Continued observation showed that the efficiency of the prior art edge liquid removal apparatus continued to deteriorate over time. It was observed that the vacuum reading for the prior art edge liquid removal apparatus was rising over time. These observations are indicative of a growing deposit of solidified coating composition in or around the vacuum slot. Through the course of the experiment, the vacuum reading on the edge liquid removal apparatus of the current invention remained steady at 130 inches of water vacuum. A steady reading indicates the absence of any significant deposit of solidified coating composition in or around the vacuum slot.

After a period of approximately 5 hours from the start of the experiment, the prior art edge liquid removal apparatus was observed to be failing to remove all of the edge guide flushing water. This indicates a condition of nearly total plugging of the vacuum slot.

While the prior art edge removal apparatus was in a failed condition, the edge liquid removal apparatus of the current invention showed no degradation in the efficiency of removal of the intercepted coating composition and flushing liquid.

After 6 hours from the beginning of the experiment, the test was terminated, and both edge liquid removal devices were inspected. On the vacuum block in accordance with the prior art, substantial deposits of solidified coating composition were present above and over as well as inside the suction slot; a portion of the suction slot was found to be completely occluded. Substantial deposits of solidified gelatin were also present on much of the blade surface. Inspection of the edge liquid removal apparatus of the current invention following the conclusion of the experiment showed virtually no solidified coating composition.

The performance of the edge liquid removal apparatus of the current invention in this experiment is very remarkable considering the rapid rate at which the gelatin solidifies due to the chemical reaction with the hardening agent as well as rapid solidification due to chill setting by virtue of the high gelatin concentration. The greatly improved performance of the current invention over the prior art is especially remarkable considering that both devices were intercepting the same amounts of coating and flushing liquids.

While the invention has been described with particular reference to a preferred embodiment, it will be understood by those skilled in the art that various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. A method of curtain coating a support with at least one layer of a liquid coating composition comprising:

a) moving the support along a path through a coating zone;

b) forming one or more layers of coating liquids to form a composite layer;

c) forming a free falling curtain from said composite layer within said coating zone which extends transversely of said path and impinges on said moving support;

d) laterally guiding said falling curtain by edge guides arranged so that the curtain coats less than the width of said support;

e) maintaining said falling curtain in wetting contact with said edge guides by distributing flushing liquid from said edge guides contiguous with said falling curtain;

f) removing liquids from an edge of said falling curtain by providing a blade extending from an edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at the edge guide;

g) removing by suction means the liquids of the free falling curtain intercepted by the blade; and h) maintaining the effectiveness of said suction means by supplying either flushing liquid from e) or an additional source of flushing liquid at a total rate of 10–100 cc/min and distributing said flushing liquid to encompass the intercepted liquids of the free falling curtain.

2. An apparatus for curtain coating a support by depositing one or more coating liquids onto a moving support comprising:

a) conveying means including a coating roll for moving said support having a width along a path through a coating zone;

b) hopper means for forming one or more flowing layers of coating liquids to form a free falling curtain which extends transversely of said path and impinges on said moving support;

c) edge guide means spaced a distance apart to produce a coating less than the width of said support for laterally guiding said falling curtain;

d) flushing means for issuing liquid from said edge guide to maintain wetting contact with said falling curtain;

e) liquid removal means for extracting liquid from an edge region of said falling curtain, the liquid removal means comprising:

i) a blade having an upper surface extending into the free falling curtain to intercept a part of the free falling curtain, said blade not contacting said support;

ii) a slot aligned and adjacent the upper surface of said blade, a face surface of the slot starting as a vertical surface in contact with the edge guide, and said slot making an angle β with a plane of the curtain such that the distance of the slot from the curtain increases as an edge of the blade which extends into the curtain is approached, and terminating the slot before the edge of the blade;

iii) suction means for providing a vacuum to said slot wherein the part of the free falling curtain intercepted by said blade is suctioned through said slot such that drag on the free falling curtain is minimized; and iv) flushing liquid supply means for either d or an additional flushing liquid supply means for encompassing with flushing liquid the liquids of the free falling curtain entering said slot.

3. The apparatus of claim 2 wherein a) the flush liquid distributing means is one or more channels said channels selected from the group consisting of a channel beginning in wetting contact with the edge guide flushing liquid and cut transversely into the blade, and extending across all or a portion of a slot entrance at a distance not farther than a line of curtain/blade intersection and a channel beginning in wetting contact with the edge guide flushing liquid and cut transversely above the slot so as to intercept all or some portion of a top and an inboard side surface of the slot;

b) the channels have a width of 0.020–0.1 inch and a depth of 0.010–0.100 inch;

c) the edge guide flushing liquid has a flow rate of 5–50 cubic centimeters per minute.

4. The apparatus of claim 3 wherein the flushing liquid distributing means contains both parts of the channels.

5. The apparatus of claim 3 wherein the channels have a width of 0.020–0.060 inch and a depth of 0.010 to 0.04 inch.

6. The apparatus of claim 3 wherein the edge guide flushing liquid has a flow rate of 30 cubic centimeters per minute.

7. The apparatus of claim 6 having the flushing liquid distributing means containing both sets of channels.

8. The apparatus of claim 2 wherein a) the flush liquid distributing means is one or more channels selected from the group consisting of a channel cut into the blade and externally supplied with flushing liquid, the blade channel extending from a supply means to at least a line of curtain/blade intersection, and bridging all or a portion of a slot entrance and a channel which is a conduit externally supplied with flushing liquid, the conduit extending from a supply means to an outlet in a top surface of the slot spanning a portion or all of the slot width, the outlet being set back no more than 0.050 inches from the slot entrance b) the blade channel has a width of 0.020–0.1 inch and a depth of 0.010–0.100 inch;

c) the blade channel is supplied with flushing liquid at the rate of 5–50 cubic centimeters per minute; and d) the conduit is supplied with flushing liquid at the rate of 10–100 cubic centimeters per minute.

9. The apparatus of claim 8 wherein the channels have a depth of 0.010–0.040 inch and a width of 0.020–0.060 inch.

10. The apparatus of claim 8 wherein the conduit is supplied with flushing liquid at its rate of 30 cubic centimeters per minute.

* * * * *